US005522198A

United States Patent [19]

Byer et al.

[11] Patent Number: 5,522,198

[45] Date of Patent: Jun. 4, 1996

[54] METHOD OF USING A WOVEN CARBON FABRIC TO PROTECT HOUSES, PERSONS AND OTHER STRUCTURES FROM FLAMES AND HEAT

[76] Inventors: Gary M. Byer, 5945 Capitol Hill Ave., Richmond, Calif. 94806; James L. Evans, 1626 Cypress Ave., Richmond, Calif. 94805

[21] Appl. No.: 425,389

[22] Filed: Apr. 20, 1995

[51] Int. Cl.[6] ..... E04B 1/00; E04G 21/00; B27N 9/00; A42B 1/00

[52] U.S. Cl. ..... 52/741.3; 2/5; 2/7; 2/8; 2/167; 182/47; 182/230; 252/601; 252/603; 252/604; 428/920; 428/921

[58] Field of Search ..... 428/229, 902, 428/920, 921, 408; 2/7, 8, 5, 167; 139/420 A; 52/741.3; 182/47, 230; 252/601, 603, 604

[56] References Cited

U.S. PATENT DOCUMENTS 4,767,656 8/1988 Chee et al. ..... 428/116

*Primary Examiner*—James D. Withers

[57] ABSTRACT

A method of using carbon fiber cloth (cfc) as a fire protection cover. Carbon fiber cloth, presently manufactured in 42 inch widths, would be snapped together to form 10–20 foot widths then used to cover houses and other items for fire protection. The carbon fiber cloth is used in its' natural form—without resins or epoxies.

1 Claim, No Drawings

METHOD OF USING A WOVEN CARBON FABRIC TO PROTECT HOUSES, PERSONS AND OTHER STRUCTURES FROM FLAMES AND HEAT

FIELD OF THE INVENTION

The field of this invention relates generally to fire resistant covers made of carbon fiber to be placed over structures or personnel to protect them from forest fires and other sources of damaging heat.

BACKGROUND OF THE INVENTION

Forest and brush fires are a serious threat to many home owners during drought months of the year throughout the country. Many such fires have consumed numerous homes and structures with no way of protecting them. Often several hours of warning of forth-coming fires are available to home owners of houses built in heavily wooded or brush covered areas. The home owners in the October 1991 Oakland fire storm would have been able to save many of their homes had they had such a fire protecting cover as our invention.

Many inventions have been made in the field of fire protection but so fare all have had the problems: (a) complicated to make; (b) expensive to manufacture; (c) bad for the environment; (d) will not protect at high enough temperatures; (e) They had idea of art to use without having a useable material to do the job.

Until now carbon fiber cloth has been used exclusively for construction of strong yet light weight devices and structures such as golf clubs and experimental aircraft—But now the high technical material may have a new use as a heat insulator for all sorts of things such as houses threatened by brush fires or personnel coverails to protect fire fighters. Carbon fiber cloth lends itself well to those new uses as a fire protector because it is light weight, strong, non-toxic (at any temperature), easy to manufacture and endures extreme heat without destruction or deterioration of composition.

We have tested carbon fiber cloth for its ability to withstand various temperatures by: (a) applying a flame of a match; (b) applying a flame from map gas torch; (c) applying heat from an acetylene and oxygen torch. None created any detectable damage to the cloth.

Tests conducted on carbon fiber cloth's ability to protect a flammable material from heat and flame had positive results. A peace of dry wood was positioned one inch from and directly behind a single layer of carbon cloth. The cloth was of style 282, 5.7 oz/sq. yd, 42" wide, 0.007" thick, a plane weave and void of any resin or epoxy. A flame from a map gas torch was applied for two minutes and no damage or visible burning of the wood was apparent.

This unique idea of using carbon fiber cloth for fire protection will enhance and allow the use of many other inventions such as: U.S. Pat. No. 4,858,395, fire protection for structures; U.S. Pat. No. 5,279,287, Coverails for protection against flash fires; U.S. Pat. No. 4,514,870, fire resistant lap protection blanket; U.S. Pat. No. 5,047,4.49, fire protection material; U.S. Pat. No. 4,262,055, fire protection materials and methods of making them; U.S. Pat. No. 4,850,173, Process for the inhibition of spread of fire and for protection against effect of fire in burning buildings. All of which depend on the use of a protective cover material that our art will support.

SUMMARY OF THE INVENTION

The present invention broadly contemplates the provision of fire protection material, commonly known as carbon fiber cloth, to offer a high degree of protection against fire and heat and embraces the discovery that such material will withstand extreme temperatures without deterioration. The cover will protect structures from burning because the material is made of carbon which will withstand temperatures in excess of 3000° C. Carbon is a very stable element and will last almost for ever under very harsh conditions such as sun light, extreme heat and in the presents of various chemicals. Carbon fiber cloth is environmentally friendly as in contrast to prior art that is composed of many complicated and questionable mixtures of chemicals and compounds. Carbon fiber cloth is readily available from companies such as Hexcel Corporation, etc. This is in contrast to prior an that must be custom made and produced. This material will be easy to handle by personnel as it is free of poisonous chemicals and compounds.

In a preferred embodiment of the invention as employed herein, the 42 inch width bolts made by U.S. companies, Hexcel Corporation, etc., would be snapped together to form 10–20 foot widths. Hence, these larger bolts of cloth would be placed on a mobile truck. A crew of fire workers could pull the cloth over a structure by means of ropes. Then the cloth would be anchored to prevent winds from blowing it off. Also another preferred method to deploy the cloth would be to have pre-measured lengths stored on the crown of the roof in rolls and deployed automatically when a fire is detected. The prior an of McQuirk, U.S. Pat. No. 4,858,395 would be a good method to deploy our fire protection by using his roller system. Another way would be to simply store the material in a shed or garage use as needed.

Fire fighters would appreciate having such a material available to protect them from fire by use of coveralls such as the art of Wiseman, Sr., U.S. Pat. No. 5,279,287. Coverall made of carbon fiber cloth rather than nomex or prior an would endure much higher temperature. Forest fire fighters would be safer if they had the use of this art in the form of a tent. Cars, cycles and airplanes or anything that can catch fire could be covered with carbon fiber cloth to starve the fire of oxygen and thereby putting it out.

Although particular embodiments of the present invention have been described in the foregoing description, it will be understood by those skilled in the art that the invention is capable of numerous modifications, substitutions and rearrangements without departing from the spirit or essential attributes of the invention. References should be made to the appended claim, rather than to the foregoing specification, as indicating the scope of the invention.

We claim:

1. A method of using woven carbon fabric to protect houses, people and other structures from heat and flame; said fabric consisting essentially of carbon fibers having a weave and thickness sufficient to prevent penetration of a flame; said method comprising the following steps:

(a) covering a house, person or other structure with said woven carbon fabric to form a barrier between the house, person or other structure and a source of heat and flame, and (b) anchoring said woven carbon fabric to maintain said barrier between the house, person or other structure and the source of the heat and flame.

* * * * *